US005517180A

United States Patent [19]

Masi et al.

[11] Patent Number: 5,517,180

[45] Date of Patent: May 14, 1996

[54] PERSONAL PROTECTION DEVICE

[76] Inventors: J. Roger Masi, 55 State St., Hackensack, N.J. 07601; William F. Hall, 158 Harvest La., Lincoln Park, N.J. 07035

[21] Appl. No.: 280,392

[22] Filed: Jul. 26, 1994

[51] Int. Cl.[6] ..... G08B 23/00

[52] U.S. Cl. ..... 340/573; 340/574; 340/693; 222/613

[58] Field of Search ..... 340/573, 574, 340/6934, 321; 116/DIG. 44, 211, 2, 4, 77; 222/509, 78, 3, 39, 94, 103, 113, 175, 192, 613; 200/61.93, 61.86

[56] References Cited

U.S. PATENT DOCUMENTS

| | | | |
|---|---|---|---|
| 3,794,791 | 2/1974 | Thomson | 340/321 |
| 4,121,736 | 10/1978 | McGaw, Jr. | 222/94 |
| 4,241,850 | 12/1980 | Speer | 222/39 |
| 4,322,194 | 6/1994 | Roberts | 222/103 |
| 4,449,474 | 5/1984 | Mariol | 116/2 |
| 4,581,021 | 4/1986 | Landau et al. | 222/103 |
| 4,716,402 | 12/1987 | Francis | 340/321 |
| 4,990,327 | 2/1991 | Neirinckx | 222/94 |
| 5,011,044 | 4/1991 | Brown | 222/175 |
| 5,052,590 | 10/1991 | Ratcliff | 222/94 |
| 5,065,904 | 11/1991 | McCaffrey et al. | 222/3 |
| 5,137,178 | 8/1992 | Stokes et al. | 222/103 |

*Primary Examiner*—Brent A. Swarthout
*Assistant Examiner*—Benjamin C. Lee
*Attorney, Agent, or Firm*—Sheldon H. Parker

[57] ABSTRACT

A cylindrical personal protection device is disclosed having an ampule section containing a flexible, multi-chamber ampule with a nozzle, a light and a removable safety cap. The ampule contains a deterrent spray and a glowing liquid. At least a portion of the ampule portion is removable allowing access to the ampule. A trigger proximate the ampule extends beyond the periphery of the ampule section. A body section has a battery receiving area and an alarm. The electronics connect the battery receiving area, trigger, alarm and light. The electronics activates the light and alarm, in response to activation of the trigger, causing them to pulse simultaneously. The ampule portion and the body portion are removably connected to one another. At least a pair of protective bumpers prevent damage. A safety pin prevents the trigger from contacting the ampule and partial removal of the safety pin allows the trigger to contact the ampule, expelling the contents of the ampule, and activating the alarm and light.

10 Claims, 5 Drawing Sheets

PERSONAL PROTECTION DEVICE

BACKGROUND OF THE INVENTION

1. Field of the Invention

The instant disclosure relates to a convenient, hand held personal protection device which provides additional protection through multi-layering its defenses and alarms.

2. Brief Description of the Prior Art

With the increasing prevalence of violent crime is an acute need for a personal protection device that is safe, easy to use, and compact. Sales of typical defensive sprays, such as Mace, have increased dramatically in the last several years. The media coverage of violent crimes, particularly rapes and muggings against women, have heightened the fear that women, as well as men, feel in conducting their personal or business affairs in urban or suburban areas. Not only have the media extensively covered the wave of violent crime in this country, but the increases in violent crime have been documented statistically. In New Jersey, for example, violent crime rose 67% since 1974. Among juveniles, violent crimes increased 69% in that twenty year period and arrests of juveniles for weapons offenses rose 60% last year alone. A personal protection device, therefore, will serve the dual purpose of both protecting the potential victims and easing anxiety with the knowledge that an attacker can be effectively deterred by the device.

Various personal protection devices have been devised to deter attackers. In U.S. Pat. No. 5,032,824 to Corbin, a hand held alarm is disclosed which sounds a high intensity light and loud horn. The Corbin device, however provides no physical deterrent to the attacker. In a remote area, an attacker may gamble that no one will hear the alarm or, alternatively, he can finish the attack prior to anyone's arrival.

U.S. Pat. No. 4,967,684 to Vidovic et al discloses a loud audio alarm system for a ski-pole to locate lost skiers. Again, there is no physical deterrent to the attacker.

U.S. Pat. No. 5,086,377 to Roberts discloses a defense baton which incorporates audible and visible alarms with a defense spray. Carrying the baton, however, would be awkward and would be obvious to a potential attacker. The obviousness may dissuade some potential attackers, however many may simply alter their attack to render the baton ineffective.

Novak, in U.S. Pat. No. 5,289,164 discloses a glove which incorporates a signal and spray retardant. The device, although providing a physical deterrent, is not readily put on and removed.

U.S. Pat. No. 4,449,474 to Mariol discloses a personal security device which utilizes a two piece telescoping housing. The device incorporates a manual whistle, flash cube and pressurized gas. The odorous pressurized gas may also include a paint or stain. When the pressurized gas is expelled it emits a shrieking noise. The Mariol patent provides the advantage over many prior art patents in that it incorporates a deterrent to the attacker. However, the skrieking noise appears to be a continuous sound, which may be mistaken for other sounds. The flash cube provides only one opportunity to visually blind the attacker. The Mariol patent does not allow for any misses. The sound is only emitted during the spraying of the gas and the light is only a rapid flash.

In U.S. Pat. No. 4,846,044 an electric stun gun using electrically conductive fluid is disclosed. The stun gun disclose although effective, is not portable to the extent that it will fit into a pocket or purse. A more portable stun gun is disclosed in U.S. Pat. No. 4,843,336 to Kuo. The stun gun also incorporates a siren and strobe light. The stun gun, however requires a proximity to the assailant which may not be desirable.

The prior art does not provide a small, convenient, multi-layered personal protection device. The instant invention discloses a device that combines multiple layers of defense against potential attackers, together with small size, safety and convenience of use.

SUMMARY OF THE INVENTION

A cylindrical personal protection device is disclosed which has an ampule section with a first end and a second end, and containing a flexible ampule with a nozzle which extends through the first end of the ampule section. At least a portion of the first end of the ampule portion is removable, thereby allowing access to the ampule. At least one trigger is proximate the ampule and extends beyond the periphery of the ampule section. The ampule section further comprises a light proximate its second end. A safety cap, which can be friction fit over the protective bumpers, covers the first end of the ampule section. Alternatively, the safety cap can be spring hinged to a portion of the protective bumpers. When the spring hinged safety cap is used, the safety pin extends beyond the safety cap, thereby preventing the safety cap from opening. A body section has a first end and a second end with a battery receiving area and an alarm which is proximate the second end. The electronics connect the battery receiving area, trigger, 110 DB piezo alarm and light. The electronics activates the light and alarm, in response to activation of the trigger, causing them to pulse simultaneously. The light and alarm can be activated immediately or delayed by a predetermined time period. The ampule portion and the body portion are removably connected to one another. At least a pair of protective bumpers, having a periphery greater than the periphery of the personal protection device, are provided to prevent damage. A safety pin extending from the second end of the body section to proximate the first end of the ampule section runs in a groove dimensioned to receive the safety pin. The safety pin prevents the trigger from contacting the ampule. Partial removal of the safety pin, through use of a gripping portion, allows the trigger to contact the ampule, expelling the contents of the ampule, and activating the alarm and light.

The ampule comprises multiple interior dividers which divide the ampule into multiple chambers. The multiple interior dividers break upon contact by the trigger, thereby allowing the contents of the chambers to mix. One of the multiple chambers contains an irritative substance, such as pepper fluid. Additionally, at least one of the multiple chambers contains a marking substance such as a glowing fluid. The first portion of glowing fluid is maintained in the second of the multiple chambers and the second portion of the glowing fluid is maintained in the third of the multiple chambers and breaking the dividers allows the first and second portion of the glowing fluid to mix prior to expulsion from the nozzle. The light, once activated, repeatedly flashes on an off and the activated alarm is intermittent.

In an alternate embodiment, a section of the body portion proximate the battery receiving area is removable, thereby allowing access to the battery receiving area. Additionally, a second trigger and a second safety pin, approximately opposite one another, can be used. An alternate ampule comprises multiple interior dividers dividing the ampule into multiple chambers, at least one of the multiple interior dividers being a pliable member, thereby preventing the contents of at least two of the chambers from mixing. Dual nozzles can be positioned to expel the contents of the two chambers.

BRIEF DESCRIPTION OF THE DRAWINGS

The advantages of the instant disclosure will become more apparent when read with the specification and the drawings, wherein.

DETAILED DESCRIPTION OF THE INVENTION

The design of the instant personal protection device provides a number of advantages over the prior art. The device is a non-lethal defensive weapon that is easily used and provides a high degree of protection against a potential attacker. The device is capable of being stored and carried for long periods of time without losing it effectiveness. Since the device is not a lethal device, its accidental triggering or its usage by unauthorized individuals or children would not cause permanent damage. In fact, since the device, in the preferred embodiment, contains only one pepper spray and glowing fluid emission, as opposed to multiple emissions in the standard Mace devices, the device is thereby rendered safer in the hands of unauthorized individuals. The instant device is inexpensive to manufacture, thereby making it readily available to the majority of consumers.

Figure 1:
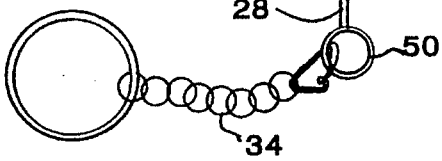
FIG. 1 is a cutaway front view of the protection device of the instant invention assembled for use.
Figure 1:
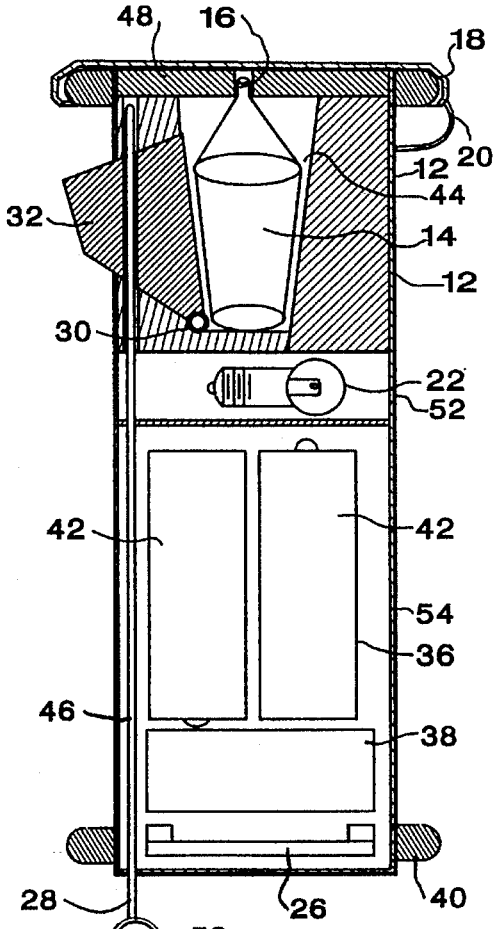

Prior art defensive sprays are generally rather large and bulky, which vary greatly in size and volume, in order to offer the ability of the victim to spray the device on a repeated basis. The likelihood, however of a victim shooting more than one spray while under attack is very slight. The preferred embodiment of the instant device provides a single application spray, thereby enabling the device to be easily hand held. The personal protection device 10 is illustrated in FIG. 1 and, as illustrated herein, is substantially cylindrical. This is not intended to limit the scope of the invention and any configuration, or material, can be substituted which meets the criteria disclosed herein. The contents of the personal protection device 10, as well as the alternate embodiments, are encased in a shock resistant case 12 which preferably has approximately a one inch diameter and four inch length. The shock resistant case 12 has safety bumpers 40 encircling the top and bottom of the device 10 to resist impact. The safety bumpers 40 can be manufactured from hard rubber or other suitable materials which will protect the case 12. The case 12 uses a high impact shock resistant plastic to prevent breakage of the case 12, or its contents, in the event the device 10 is thrown on the ground or stepped on. Alternatively, an aluminum or other metal case can be used, dependent upon cost of manufacture and aesthetics.

A trigger button 32 is placed adjacent the ampule 14, extending beyond the periphery of the case 12. The trigger button 32 is prevented from accidental engagement through use of a safety pin 28. The trigger button 32 must be manufactured with releasable receiving means for the safety pin 28 to allow the device to be armed and subsequently unarmed. An example would be to manufacture the trigger button 32 with a protrusion which, when the safety pin 28 was in place, would prevent the trigger button from being pressed in toward the ampule 14. Other means, such as grooves, receiving holes or latches, can be used and are well known by those skilled in the art.

Figure 3:
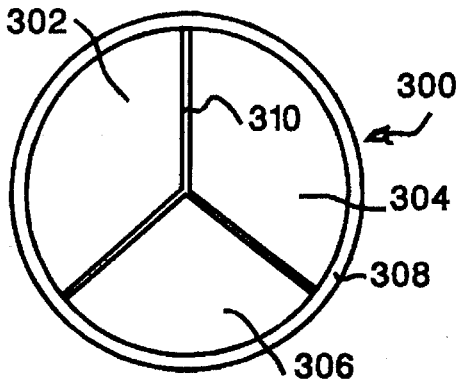
FIG. 3 is a cutaway top view of the ampule of the instant invention.
Figure 5:
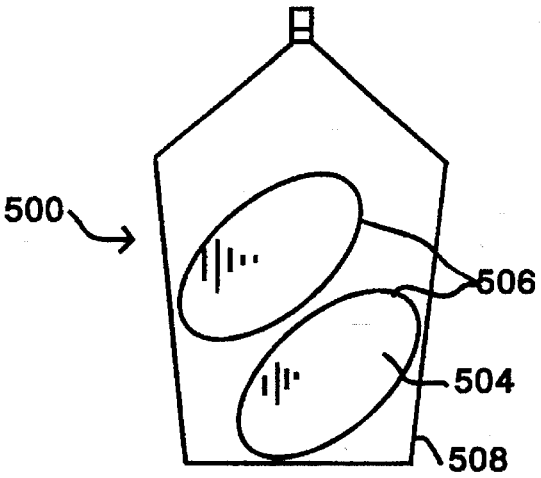
FIG. 5 is an alternate embodiment of the ampule of the instant invention.
Figure 4:
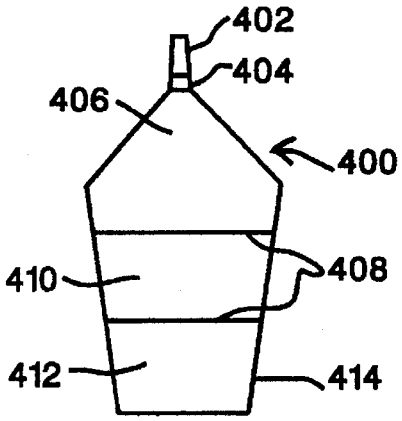
FIG. 4 is an additional embodiment of the ampule of the instant invention.

The ampule 14 is placed within the case 12 where it is protected from unintentional breakage. The interior of the case 12 is constructed to cradle the ampule 14 within the ampule receiving area 44 which prevents the ampule 14 from sliding around. The interior of the ampule 14 can be one of several designs, three examples of which are illustrated in FIGS. 3–5. The ampule 14 contains a combination of a deterrent spray, such as pepper spray which is derived from cayenne pepper, and a light activator glowing fluid. Certain deterrent sprays are illegal in various states, however the instant device can accommodate any of the liquid deterrent sprays commonly available, and use would be dependent upon the regulations within the state of purchase. In states where deterrent sprays are illegal, the ampule can contain only the glowing fluid for use in combination with the light and alarm. The deterrent spray and glowing fluid combination is released by manually squeezing the trigger 32, producing an approximately ten (10) foot spray range for approximately two (2) to four (4) seconds. The trigger 32 pivots around the trigger pivot 30 which is secured within the case 12. The pivot 30 must allow the free rotation of the trigger 32 and not inhibit any contact between the trigger 32 and the ampule 14. Alternatively, a leaf, or other type of spring, can be incorporated within the trigger pivot 30 to assist in the squeezing of the trigger. In the event a spring mechanism is added, a detent mechanism must also be incorporated. The chemical outline and description of the glowing fluid is described hereinafter. The ampule 14 can be readily replaced through the removal of the ampule retaining panel 48. The ampule retaining panel 48 is retained within the case 12 through friction fit, interlocking tabs, screws or other retaining methods known in the art. The ampule retaining panel 48 must be secure enough to prevent the weight of the filled ampule 14 from dislodging the panel 48 during handling.

Figures 8, 11:
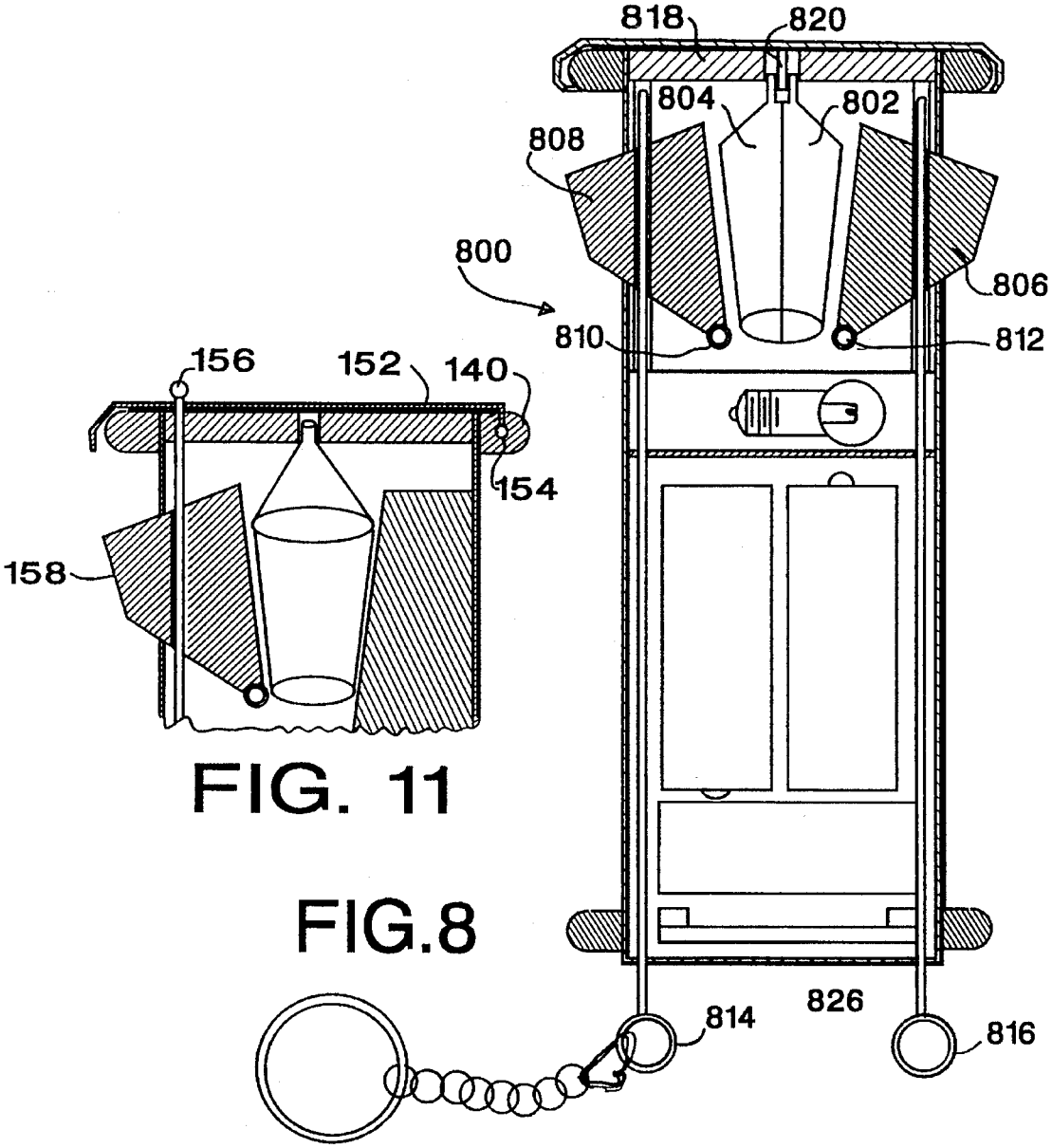
FIG. 8 is an alternate embodiment of the protection device of the instant invention.
FIG. 11 is an alternate closure top for the instant disclosure.

When not in use, the top of the case 12 is covered with a snap-on safety cap 18 or, alternatively, a spring loaded safety cap 152, as shown in FIG. 11. The snap-on safety cap 18 would be removed at the time the device 10 is armed. If the device 10 is subsequently unarmed, the snap-on safety cap 18 is replaced. The snap-on safety cap 18 can optionally be provided with a retaining cord 20 which prevents the snap-on cap 18 from being completely removed from the device 10. The hinged cap 152 is attached to the protective bumper 140 at the safety cap hinge 154 and must be flipped open prior to activation of the trigger 132. The safety pin 156 extends completely through the hinged cap 152 preventing the hinged cap 152 from accidentally opening. Once the safety pin 156 is removed from the hinged cap 152, the hinged cap 152 automatically opens, readying the device 10 for use. The safety caps 28 and 152 not only prevent the accidental disbursement of the fluid but also prevent the clogging of the nozzle 16 of the device 10 during extended storage.

Figure 6:
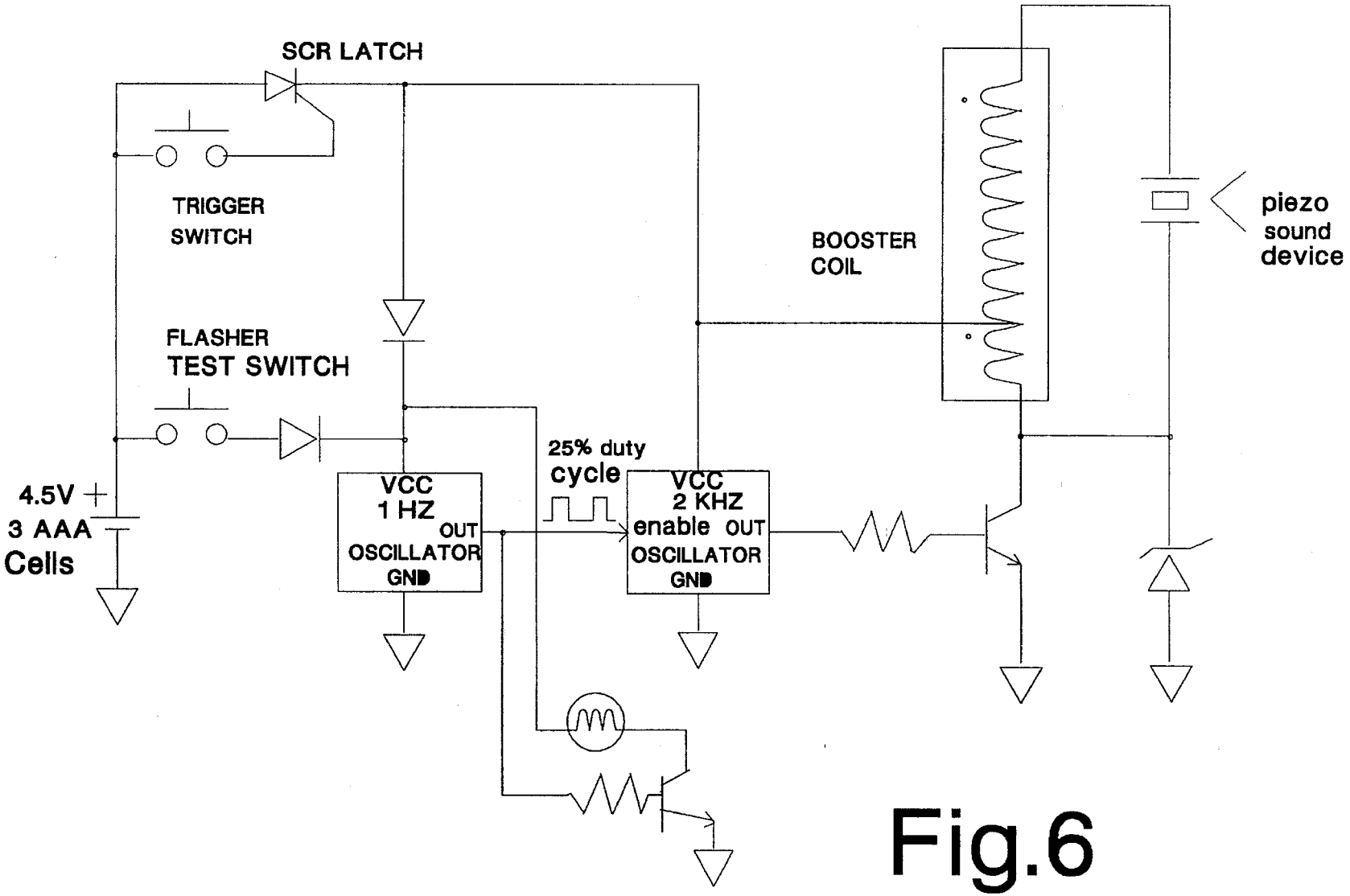
FIG. 6 is a schematic of the electronics of the instant invention.

The device 10 further contains a recessed flashing light 22 which is covered with a wide disbursing lens 24 for approximately 360 degree visibility. The lens 24 is preferably shock resistant and flush with the case 12 to prevent breakage if the device 10 is dropped. The device 10, as disclosed, incorporates an incandescent light which is pulsed in a strobe fashion. This is advantageous as the incandescent light provides greater power and cost savings than any other light source. The light is preferably equipped with a flashing or strobe type circuit, as illustrated in the schematic of FIG. 6 and well known in the prior art. The device 10 is further provided with a 110 decibel alarm 26, which is preferably a 110 DB piezo which emits a piercing, varying sound timed to correspond with the flashing light 22. In the preferred embodiment, the device 10 emits the light and sound pulse simultaneously in an intermittent manner, thereby creating a sound signature that is more readily heard. The intermittency also allows both the light and sound to be produced longer and brighter by lessening the drain on the batteries. Optimally, the light and the sound would pulse for a duration of one-quarter of a second at a rate of once per second. This time duration allows the sound and light to pulse for a minimum of five (5) minutes using the batteries incorporated herein.

The device 10 should be weighted so it is more likely to land in a position to allow the light to be visible. If the device 10 is unweighted, there will be a percentage of times that the device 10 lands with the light facing downward, thereby lessening the visibility. The device 10 can be weighted through the bumpers 40, placement of the batteries or other means which is convenient for manufacture. The cylindrical configuration is advantageous in that no matter on which side the device 10 lands, it will roll to face the light 22 upward.

The device 10 is placed in the armed mode through use of the safety pin 28 which is accessible from the bottom, or other convenient location, of the device 10. The safety pin 28 can easily be removably attached to a key chain 34 through use of a loop, clip, etc., to allow for optional use of the chain 34. The end of the safety pin 28 should be equipped with means, such as a knob or a loop 50, which will allow the user to grasp the safety pin 28 firmly enough to pull the pin 28 into the armed mode without the need of a key chain 34. The safety pin 28 is pulled to partially remove it from the case 12, thereby enabling the trigger button 32 to come in contact with the ampule 14 when pressed. The safety pin 28 is equipped with a stop notch and detent arrangement 46 which prevents the complete removal of the pin 28 from the case 12. The safety pin 28 must have sufficient tension to prevent accidental activation and should be dimensioned to require several inches to be pulled in order to put the device 10 into the ready mode. The safety pin 28 is prevented from readily slipping from the case 12. Other means, such as a detent arrangement can be utilized. The safety pin 28 must also be retractable, thereby enabling the device 10 to be unarmed and placed in a purse or pocket. The portion of the safety pin 28 positioned within the case 12 in the unarmed position is preferably colored red, orange or yellow to clearly notify the user when the device 10 is in the armed mode.

To arm the protection device 10, the safety pin 28 is pulled, thereby releasing the trigger 32 to allow for activation when required. The protection device 10 can then be used simply by pressing the trigger 32 and breaking the ampule 14. The deterrent spray, together with the glowing fluid, are ejected from the nozzle 16 of the device 10. Additionally, the light 22 and the alarm 26 are both automatically activated when the trigger button 32 is pressed, thereby activating the trigger switch contacts 164, as set forth in FIG. 6. Alternately, the light and sound can be delayed for several seconds after the deterrent spray and light activating liquid is expelled. The time delay prevents the user from being startled by the sound and light and dropping the device 10 prior to complete expulsion of the contents, however it should not be more than a 1–5 second delay after the expulsion of the liquids. The delay can be either a mechanical or electronic device, both of which are well known in the prior art.

The device 10 is powered by three inexpensive widely available triple "A" cell batteries 42 which are placed in the lower portion of the device 10 in the battery receiving area 36. The power of the batteries 42 can be checked in the unarmed mode by pressing the safety pin 28 inward causing the flashing light 22 to flash if the batteries 42 are good. A portion of the insulated safety pin 28 is left uninsulated and, when pressed inward, comes in contact with the flasher test switch 162, as shown in FIG. 6. This also serves to check on the brightness of the light, which is especially critical if the batteries 42 and ampule 14 have been replaced after use, possibly reducing the effectiveness of the light.

Figure 2:
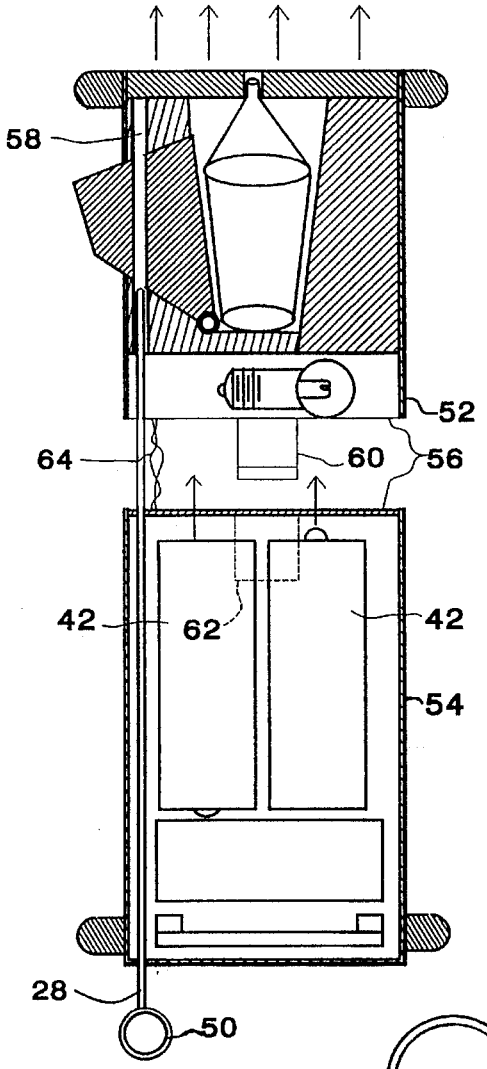
FIG. 2 is a cutaway front view of the device of FIG. 1 separated for battery replacement.

Once activated the light 22 and alarm 26 continue to be activated until the batteries 42 lose power or the device 12 is opened and the batteries 42 disconnected. The ampule section 52 is separated from the battery section 54 at the separation line 56, as shown in FIG. 2. During disconnection, the safety pin 28 is partially or completely removed from the ampule section 52 and care must be taken when reassembling the device 10 to maintain the safety pin 28 in the proper position. This can be facilitated by providing a receiving channel or groove 58 within the ampule section 52. The bayonet connector 60 is provided in the ampule section 52 which interacts with the bayonet receiving area 62 within the battery section 54. The bayonet connector 60 and receiving area 62 serves to firmly connect the ampule section 52 to the battery section 54. The ampule section 52 swivels around the safety pin 28 to expose the batteries 42 for removal and replacement. The electronic connectors must provide ample length to allow for the ampule section 52 to swivel away from the battery section. Alternately, the required electronic connectors 64 between the ampule section 52 and the battery section 54 can be provided with sufficient length to allow for the two sections to be separated far enough to allow for the removal and insertion of batteries 42.

The glowing fluid used herein is known as Lightstick Activator Component sold by Omniglow Corporation. The glowing liquid contains Butanol, t-, Dimetyl phthalate and hydrogen peroxide and is commonly used in lightsticks. The chemicals are stored separately and are activated once they are mixed, glowing for at least one hour. By spraying the glowing liquid along with the spray, the assailant is identified for possible apprehension. The advantage of the glowing liquid versus paint is the glowing liquid does glow in the dark. This makes it more difficult for the attacker to hide. FIGS. 3–5 illustrate three methods of containing the glowing fluids, and are not intended to limit the scope of the invention. FIG. 3 illustrates ampule 300 which comprises three compartments, 302, 304 and 306, which are separated by a vertical, brittle plastic divider 310. The outer shell 308 of the ampule 300 is manufactured from a soft, pliable plastic material which will bend but not crack. The material used for the outer shell 308 must also have the ability to retain liquid materials for long periods of time. Two of the compartments 302 and 304 contain the separated glowing liquid while the third compartment 306 contains the deterrent spray. The plastic divider 310 is crushed by the impact of the trigger button 32, thereby mixing the three fluids and causing the fluids to be ejected from the nozzle 16 of the device 10. An alternative to the vertical ampule 300 is horizontal ampule 400 of FIG. 4. As in ampule 300, the outer shell of ampule 400 is manufactured from a soft, pliable plastic material and the dividers 408 from a brittle plastic. FIG. 4 additionally illustrates the nozzle 402 and nozzle plug 404 which are common to the ampules disclosed herein. The nozzle plug 404 prevents the fluid, or fluids, from spilling or leaking prior to usage. The nozzle plug 404 can be either manufactured from a brittle material such as used in the dividers or a soft material which would readily separate from the pressure of the spray. FIG. 5 illustrates an ampule 500 which utilizes two separate containers, 502 and 504, floating one within the ampule shell 508. The separated glowing fluids are placed within the two separate containers 502 and 504 which are manufactured from the brittle plastic for easy breakage. The the deterrent spray is contained within the ampule shell 508 which is manufactured from the same pliable material as ampule shells 308 and 414. As disclosed in FIG. 4, the nozzle plug 510 prevents the deterrent spray from spilling out of the nozzle 512.

The outer shell of all ampules, whether or not illustrated herein, must be of a pliable material which will not break but rather bend. This flexibility allows for the rapid breakage of the dividers, allowing the chemicals to mix. It is also critical that the brittle plastic, or substitute material, be easily broken upon the application of pressure from the trigger 32, while not being so brittle as to break inadvertently.

The light activator glowing fluid disclosed heretofore causes some eye and skin irritation, however this irritation is moderate and no permanent damage should result to the attacker. As an alternative to the glowing fluid, any type of light reflecting paint, either in bright yellow, orange, or red, can be used in the device. If materials are used which can be combined, the ampules can be reduced to two, or even one, compartment. The light activator glowing fluid provides the benefit that it does not require an external source of light for visibility.

The electronics 36 of the personal protection device 10 are illustrated in FIG. 6. The schematic illustrated herein is only one possible arrangement and alternate schematics can be designed by one versed in the art.

Figure 7:
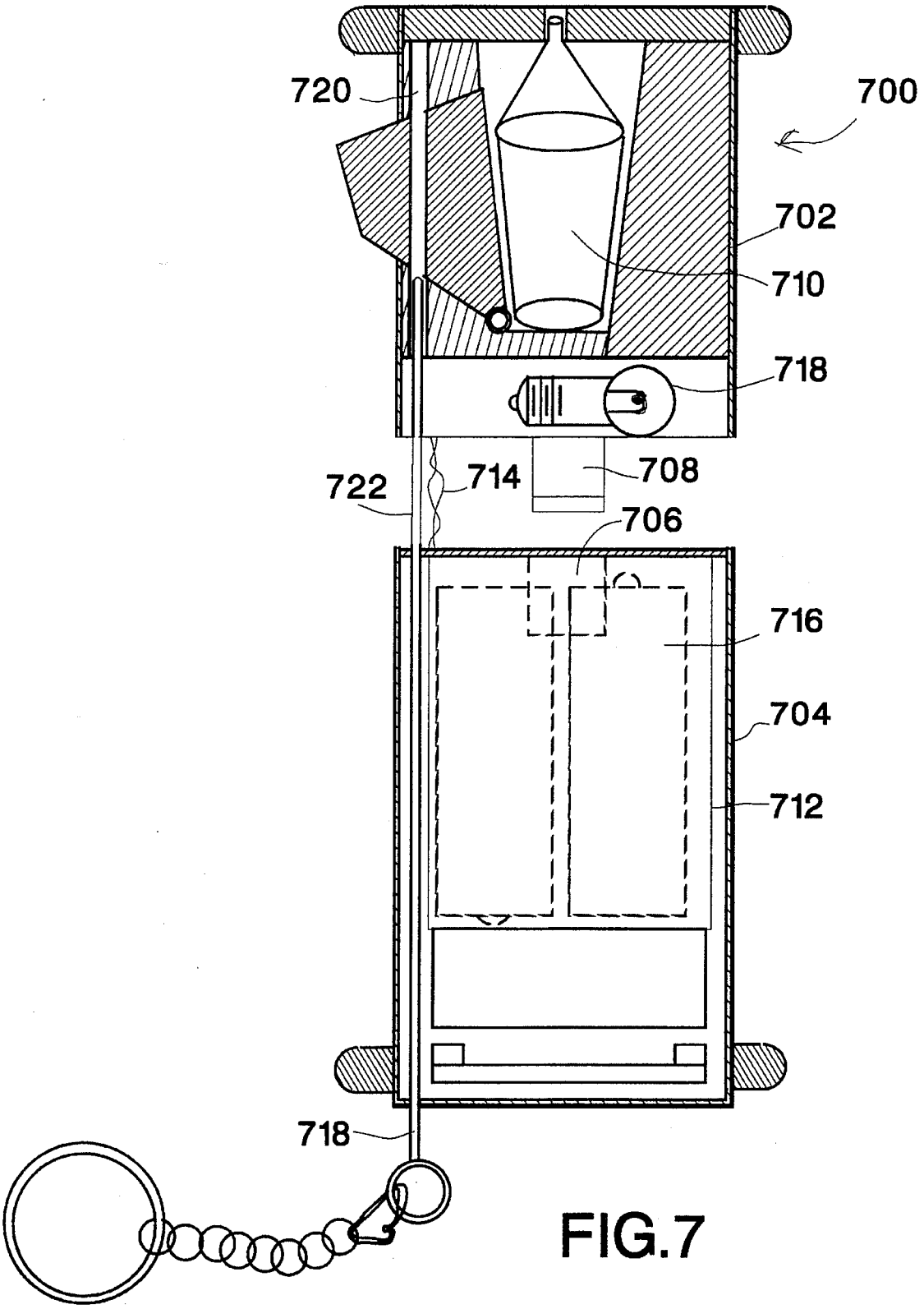
FIG. 7 is an alternate embodiment of the protection device of FIG. 1

An alternative embodiment of the instant invention is personal protection device 700 as illustrated in FIG. 7. This embodiment allows for the replacement of the entire fluid component 702 of the device 700. The fluid component 702 is removed from the base 704 once the ampule 710 has been used and a new fluid component portion 702 purchased and snapped into the base 704. The fluid component 702 also includes the light 718, as the light bulb could easily become dislodged, broken or burn out. The mechanism illustrated herein uses a bayonet connector 708 and bayonet receiving area 706. This method of separating the fluid component 702 and the device base 704 can also be used to access the batteries. The fluid component 702 is configured as disclosed in FIGS. FIGS. 1 and 2, however in this embodiment the safety pin 718 is entirely removed from the fluid component 702, thereby making the channel or groove 720 within the fluid component portion 702 critical. This embodiment also uses the bayonet connector 708 and 706 as disclosed heretofore. The electrical connections 714 must be able to be removed to replace the fluid portion 702. A standard male/female plug-in components 722 are provided which readily disconnect and reconnect the electronics located in the base 704 to the new fluid component 702..

FIG. 7 also illustrates an alternative battery replacement method through use of the removable battery panel 712. This allows the batteries 716 to be replaced in the device by either utilizing a screw driver to unscrew the battery panel 712 or by using a snap out configuration along a seam of the battery panel 712. This allows the end of a screw driver to be placed in a seam between the battery panel 712 and the base 704 and then turned, thereby snapping open the battery panel 712 for battery replacement. Although other methods of securing the battery panel 712 can be used, the method must be sufficiently secure to prevent an attacker from easily disarming the device by removing the batteries.

In FIG. 8 the personal protection device 800 is provided with double ampules 802 and 804. The center divider 828 is a rigid material which interacts with the ampule brace 820 to prevent the both sides of the ampule 830 from activating. The double ampules 802 and 804 are shown in more detail in FIGS. 9 and 10, as disclosed further herein. The personal protection device 800 is also provided with double trigger 806 and 808. The double triggers 806 and 808 independently rotate on pivots 810 and 812, thereby enabling the triggers 806 and 808 to be activated separately to activate the ampules 802 and 804 independently. Each of the double triggers 806 and 808 is provided with safety pins 816 and 814, respectively. This prevents the second ampule from being activated inadvertently.

FIG. 8 also illustrates the dual ampule replacement panel 818, which can be removed to replace the ampules and can be incorporated with any of the device 10 embodiments disclosed herein. The dual ampule replacement panel 818, as illustrated herein for a double nozzle ampule, additionally comprises an ampule brace 820 which retains the ampule in position and prevents both portions of the ampule from being activated simultaneously. The ampule replacement panel 818 is preferably a tight snap-in fit, however other means can be utilized, dependent upon ease of manufacturing and cost. The ampule replacement panel 818 can be used with any of the foregoing embodiments to allow the ampules to be removed and replaced. This allows for easier replacement than FIG. 7, as the electronics are not involved, however there will be a limited number of times this can be utilized due to the limited life of the light bulb. In the event light bulb access is provided for replacement of the bulb, the ampules can continually be replaced through use of replacement panel 818.

Figure 9:
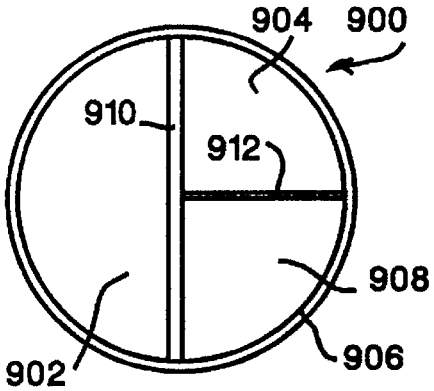
FIG. 9 is a cutaway top view of an alternate nozzle embodiment having dual nozzles

The dual ampule 900 of FIG. 9 comprises three separate compartments 902, 908 and 904. The half compartment 902 is divided from the quarter compartments 904 and 908 by a pliable wall 910. The pliable wall 910 is manufactured from the same material as the shell 906 and prevents the contents of the half compartment 902 with the quarter compartments 904 and 908. The divider 912 is manufactured from the brittle material described hereto, thereby allowing the contents of the quarter compartments 904 and 908 to mix. The dual ampule 900 is one of the interior configurations which can be used with the dual nozzle ampule 920. The use of the quarter compartments 904 and 908 in combination with the half compartment 902, allow for the complete separate of the glowing liquid from the deterrent spray. By preventing the glowing liquid from mixing with the deterrent spray, any dilution to the brightness of the glowing liquid is prevented. The use of the dual nozzle ampules and the necessity of separating the glowing liquid and the deterrent spray is dependent upon the chemicals being used.

Figure 10:
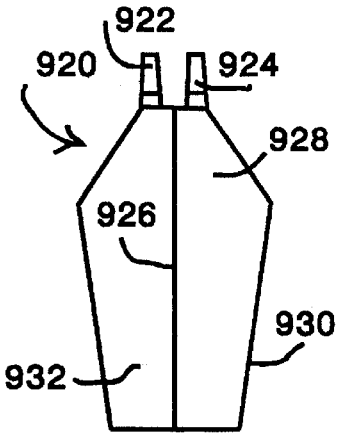
FIG. 10 is a side view of the ampule of FIG. 9.

The ampule 900 of FIG. 10 illustrates clearly the dual nozzles 922 and 924 through which the contents of compartments 902, 908 and 904 are released.

The advantage to independent activation is dependent upon the final use of the device 10. When used as an personal protection device, the double triggers 806 and 808, in combination with the dual ampules 804 and 802, appropriately divided, can provide for double "shots" of the deterrent spray and glowing fluid. An alternative use for the device 800 would be for mail, or other delivery persons, as a protection against vicious dogs. The ampules 804 and 802 can be filled with animal repellent and the alarm 826 can be a high pitched frequency which deters animals. The alarm can additionally be used as a device for notifying a person's location when lost. These are only two examples of alternative uses for the instant disclosure.

The device 10 can be provided with a firm case to protect the exterior if so desired.

The combination of the four way safety: the pepper spray, the glowing fluid, flashing light and sound device renders the device very effective against any potential attackers. The layering of the protective pepper spray, the glowing fluid, and the light and sound device provides backup and redundant protection. For example, if the victim is unable, due to the suddenness of an attack, to hit the attacker with the pepper spray to incapacitate the attacker, the victim has other opportunities for deterrence. The glowing fluid is simultaneously sprayed on the attacker and the flashing light and sound device triggered which provide additional high measures of protection. All that is necessary for the triggering of the flashing light and sound device is the simple depression of the trigger button. While the victim may not succeed in hitting the attacker with the pepper spray and glowing fluid, the victim should have the opportunity to activate the light and sound device by pressing the trigger button. The utilization of only one spray opportunity against a potential attacker allows the device to be sized conveniently for the average user and can easily fit in the palm of one's hand.

An example of use would be a woman might leave her place of work to walk to her parked car several blocks away. Prior to her reaching the street she could remove or unhinge the safety cap from the top of the device and pull the safety pin from the device, thereby rendering the device capable of being fired with an easy depression of the trigger button. Once she has safely reached her destination the safety pin could then be returned to the unarmed position, thereby deactivating the device. The safety cap would then be placed back on the top of the device to protect the top of the nozzle during storage. The safety pin can not be removed from the device.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A personal protection device, said personal protection device comprising:

an ampule section, said ampule section having a first end and a second end, an ampule, said ampule being a flexible member having a nozzle extending through said first end and multiple interior dividers, said multiple interior dividers dividing said ampule into multiple chambers, at least one trigger means, said at least one trigger means being proximate said ampule section and extending beyond the periphery of said ampule section, a light, said light being proximate said second end, a body section, said body section having a first end proximate said light and a second end, and a battery receiving area within said body section, alarm means, said alarm means being proximate said body second end, and electronic means, said electronic means being connected to said battery receiving area, said at least one trigger means, said alarm means and said light, at least a pair of protective bumpers, said protective bumpers having a periphery greater than the periphery of said personal protection device, a safety pin, said safety pin extending from said second end of said body section to proximate said first end of said ampule section, a groove, said groove extending from said second end of said body section to proximate said first end of said ampule section, said groove dimensioned to receive said safety pin, wherein said safety pin prevents said at least one trigger means from contacting said ampule and partial removal of said safety pin from said groove allows pressure applied by a user's hand to said at least one trigger means to contact said ampule, said contact breaking said multiple interior dividers, mixing the contents of said chambers and expelling the contents of said ampule, and activating said alarm means and said light.

2. The personal protection device of claim 1 wherein at least one of said multiple chambers component portions of contains a marking substance.

3. The personal protection device of claim 2 wherein said marking substance is a glowing fluid.

4. The personal protection device of claim 3 wherein a first component portion of said glowing fluid is maintained in one of said multiple chambers and a second component portion of said glowing fluid is maintained in another of said multiple chambers and the breaking of said multiple chambers allows said first portion and said second portion of said glowing fluid to mix and become luminescent prior to expulsion.

5. The personal protection device of claim 1 wherein a first of said multiple chambers contains an irritative substance.

6. The personal protection device of claim 5 wherein said irritative substance is pepper fluid.

7. The personal protection device of claim 1 wherein at least one of said multiple interior dividers being a pliable member, thereby preventing the contents of at least two of said chambers from mixing.

8. The personal protection device of claim 7 further comprising a second nozzle, said nozzle and said second nozzle being positioned to expel the contents of said at least two of said chambers.

9. The personal protection device of claim 1 further comprising a second trigger means and a second safety pin, said second trigger means and said second safety pin being approximately opposite said at least one trigger means and safety pin.

10. A personal protection device, said personal protection device comprising:

an ampule receiving section, said ampule receiving section having a first end and a second end, an ampule, said ampule being a flexible member having a nozzle extending through said first end and interior divider means, said interior divider means dividing said ampule into multiple chambers, at least one trigger means, said at least one trigger means being proximate said ampule section and extending beyond the periphery of said ampule section, a light, said light being proximate said second end of said ampule portion, a body section, said body section having a first end proximate said light and a second end, and a battery receiving area within said body section, battery means within said battery receiving area, alarm means, said alarm means being proximate said body second end, electronic means, said electronic means being functionally connected to said battery means, said at least one trigger means, said alarm means and said light, safety means, said safety means extending from said second end of said body section to proximate said first end of said ampule section, a groove, said groove extending from said body section to proximate said first end of said ampule section, said groove dimensioned to receive said safety means, wherein said safety means prevents said at least one trigger means from contacting said ampule and partial movement of said safety means from said groove allows said at least one trigger means to cause pressure to be applied to said ampule, compressing and breaking said dividers of said multiple chambers, mixing the contents of said chambers, expelling the contents of said ampule, and activating said alarm means and said light.

* * * * *